United States Patent [19]

Raley

[11] Patent Number: 4,783,231

[45] Date of Patent: Nov. 8, 1988

[54] METHOD OF MAKING A FIBROUS WEB COMPRISING DIFFERENTIALLY COOLED/THERMALLY RELAXED FIBERS

[75] Inventor: John M. Raley, Appleton, Wis.

[73] Assignee: Kimberly-Clark Corporation, Neenah, Wis.

[21] Appl. No.: 41,511

[22] Filed: Apr. 23, 1987

Related U.S. Application Data

[62] Division of Ser. No. 785,366, Oct. 7, 1985, abandoned.

[51] Int. Cl.[4] ..... D04H 3/16; B29C 35/16

[52] U.S. Cl. ..... 156/167; 156/181; 156/296; 264/518; 264/519; 264/112; 264/119; 264/168

[58] Field of Search ..... 264/518, 519, 168, 119, 264/234, 345, 230, 167, 6, 237, 112, 348, 113; 156/167, 176, 178, 181, 62.8, 161, 296, 62.2

[56] References Cited

U.S. PATENT DOCUMENTS

| | | | |
|---|---|---|---|
| 2,979,883 | 4/1961 | Waltz | 264/345 |
| 3,347,036 | 10/1967 | Daniel | 264/168 |
| 3,480,709 | 11/1969 | Jacob et al. | 264/237 |
| 3,577,498 | 5/1971 | Matsuo et al. | 264/168 |
| 3,621,092 | 11/1971 | Hofer | 264/322 |
| 3,920,784 | 11/1975 | Nakagawa et al. | 264/168 |
| 4,280,860 | 7/1981 | Shen et al. | 264/168 |
| 4,496,508 | 1/1985 | Hartmann et al. | 264/167 |
| 4,643,940 | 2/1987 | Shaw et al. | 428/308.4 |

*Primary Examiner*—Jan H. Silbaugh
*Assistant Examiner*—Mary Lynn Fertig
*Attorney, Agent, or Firm*—Paul Yee

[57] ABSTRACT

A fibrous web comprising fibers which have been differentially cooled to provide a crimped fiber conformation thereto and then thermally relaxed to a sufficient degree to at least partially decrimp the fibers and increase the loft and decrease the density of the web. Also disclosed is a process for forming a web of such type, comprising the steps of forming a web of fibers, bonding the fibers to form a bonded web, differentially cooling the fibers to provide a crimped fiber conformation thereto, and thermally relaxing the fibers to a sufficient degree to at least partially decrimp the fibers and increase the loft and decrease the density of the web, wherein the differential cooling step preferably is carried out prior to bonding of the fibers to form the bonded web and the thermal relaxing step is carried out after bonding of the fibers to form such web.

11 Claims, 2 Drawing Sheets

METHOD OF MAKING A FIBROUS WEB COMPRISING DIFFERENTIALLY COOLED/THERMALLY RELAXED FIBERS

This is a divisional of co-pending application Ser. No. 785,366, filed on Oct. 7, 1985, now abandoned.

BACKGROUND OF THE INVENTION

1. Field of the Invention

This invention relates generally to fibrous webs of a type suitable for use in absorbent articles such as disposable diapers, sanitary napkins, incontinency briefs, and the like, and to a method for making such fibrous webs.

2. Description of the Prior Art

In the art of absorbent articles such as disposable diapers, sanitary napkins, incontinency briefs, etc., it has been common practice to form the absorbent article as a laminated structure comprising a body of absorbent material such as air-felt, cellulosic fluff, or the like, disposed adjacently to a liner layer which on the side opposite the absorbent body is disposed against the wearer's skin. Accordingly, the layer contiguous to the skin must have a highly transmissive character as regards the flow of fluid, e.g., urine, menstrual fluid, etc., to the absorbent body and away from the skin of the user. Further, in addition to such wicking or fluid transmissivity function, the liner layer must have a skin-side surface which is soft and nonabrasive, i.e., gentle to the skin of the user. Further, such liner layer must have sufficient mechanical strength and flexibility to impart structural integrity and maintain the form of the absorbent article, due to the fact that the absorbent body itself typically has a low degree of mechanical strength and structural integrity.

Although the prior art has attempted to accommodate the foregoing requirements for the liner layer of the absorbent article, such efforts primarily have been directed at improving the mechanical strength and integrity characteristics of the liner material, frequently at the expense of its softness and surface texture characteristics. In some instances, the prior art has attempted to provide the liner as a laminated structure, wherein a top layer, for disposition against the skin of the wearer, is soft and fluffy in character, while a backing layer, disposed contiguous to the absorbent body, is relatively stronger and less flexible in nature Nonetheless, such composite structures, in the provision of the backing layer of such type, generally increase the resistance to fluid transmissivity through the liner to the absorbent body.

U.S. Pat. No. 4,333,979 to M. A. Sciaraffa, et al. discloses a nonwoven web of thermoplastic fibers which is pattern-bonded and further embossed to provide an increase effective thickness providing softness and bulk of the nonwoven material while retaining other desirable characteristics such as strength. The web is a spunbonded material composed of closely-spaced point fused areas (constituting a spunbonded pattern) with the subsequently applied embossing pattern comprising much larger embossments. The resultant material is said to be highly effective as a liner for disposable products such as diapers, sanitary napkins and the like. The nonwoven web in this system is bonded by passage through a pattern nip formed by heated rolls, whereby individual compacted fused areas are formed occupying about 5 to 50% of the total web area with a density of about 50 to 3,200 fused areas per square inch. The further processing involves application of a gross embossing pattern imparting a substantially permanent deformation to the web in the form of a pattern of depressed areas. This gross pattern embossment is preferably obtained by passing the pattern-bonded web through a nip formed by a matched set of heated web embossing rolls. The gross pattern occupies an area of about 5–80% of the web surfaced with embossed pattern frequency in the range of from about 1 to 500 depressions per square inch. The disclosed webs have a basis weight in the range of from 0.4 ounces per square yard to 2.0 ounces per square yard, with web density being in the range of 0.08 to 0.20 gm/cc. The material of the nonwoven web includes meltspun fibers of thermoplastics such as polyolefins, polyethylene, polypropylene, polyesters, polyamides and composites thereof with cellulosic fibers. The patent describes the use of the disclosed nonwoven web as a topsheet of a diaper including a backsheet, an absorbent layer, and topsheet.

The teachings of the Sciaraffa patent relate to a doubly-embossed, single layer web. Because the web is a monolayer, the dual embossing steps will provide strengthening of the web structure, but such improvement in structural integrity is obtained at the expense of the softness and flexibility characteristics of the web stock from which the embossed product is made.

U.S. Pat. No. 4,374,888 to S. R. Bornslaeger discloses a nonwoven fabric laminate suitable for use in the manufacture of tents, outer garments, tarpaulins and the like, which comprises an outer spunbonded layer having ultraviolet radiation resistance imparted thereto, an intermediate microporous meltblown layer, preferably densified for resistance to liquid strike-through, and an inner spunbonded nonwoven layer treated for flame retardancy. The spunbonded layers preferably are formed with spotbonds, and have a basis weight of from about 0.5 to 5 ounces per square yard, with the intermediate meltblown layer having a basis weight of from about 0.5 to 2.0 ounces per square yard. Also disclosed is an embodiment wherein the spunbonded/meltblown/spunbonded laminate is pattern-bonded in a gross pattern occupying an area of 5 to 20% of the surface at a bond density of about 10 to 40 bonds per square inch. As shown in FIG. 4 of the patent, the laminate is spotbonded, and then pattern-bonded with a gross pattern of surface depressions being applied to both sides of the laminate; each layer of the laminate is correspondingly deformed by the gross pattern-bonding. The laminate is formed by lay-down of a spunbonded layer on a support belt, with the meltblown layer being formed directly on the spunbonded web, and a second spunbonded web then being applied to the meltblown layer to complete the composite, following which the entire composite is passed through a nip roll assembly for pattern-bonding. The laminate formed by the method of this patent suffers the same deficiency as the embossed web in the previously described Sciaraffa, et al. patent, in that the entire laminate is bonded, the spunbonded layers being dually bonded. Accordingly, the laminate by the inherent character of the pattern-bonding process has reduced flexibility and surface softness characteristics which, although not severely detrimental in the uses contemplated in the Bornslaeger patent, viz, in tents, outer garments, tarpaulins, and the like, render the laminate inadequate for the end-use applications contemplated for the present invention.

U.S. Pat. No. 3,912,567 to R. J. Schwartz discloses a process for intermittent autogenous bonding of a continuous filament web. The web is passed directly through a nip formed by a smooth hard-surfaced roll and a roll containing raised points on its surface, both rolls being maintained at a temperature near the softening point of the filaments. This process is carried out such that the temperature of the web is not substantially increased before maximum pressure has been developed in the nip, but at maximum pressure is rapidly raised to effect surface fusion before a significant increase in filament crystallinity occurs. The purpose of the disclosed process is to provide two-sided surface abrasion resistance, with good physical strength properties, for high basis weight webs. The term "intermittent autogenous bonding" in this patent refers to bonding by application of heat to a substantially unbonded web at intermittent areas which define the upper and lower surfaces of intermittent regions of the web which are compressed under a pressure of at least about 2,000 psi. The process disclosed in this patent involves a two-sided, monolayer web, and utilizes only one embossing step.

U.S. Pat. No. 4,069,078 to M. D. Marder, et al. discloses a finishing process for preparing nonwoven bonded sheets having high delamination strength and uniform appearance. The starting lightly consolidated sheet material is embossed by passage through a nip formed between two rolls, one of which has a multiplicity of bosses on substantially its entire surface, the bosses having a height of about 50–100% of the thickness of the sheet, with tips which have at least one dimension less than about 0.64 cm and the most prominent of which, in aggregate, form an area which is from 1–50% of the area of the surface of the roll. The resulting embossed sheet is passed through a heating zone for fusion of the surface film-fibrils and then cooled below its distortion temperature, such heating/cooling steps being carried out for each of the two sides of the sheet to obtain a bonded sheet of suitable opacity. As in the previously described prior art, this patent discloses a process for a single nonwoven sheet of material, wherein a single embossing step is carried out.

U.S. Pat. No. 4,041,203 to R. J. Brock, et al. discloses a nonwoven material comprising an impregnated mat of thermoplastic polymeric microfibers, and a web of substantially continuous, randomly deposited, molecularly oriented filaments of the thermoplastic polymer. The microfiber mat and the continuous filament web are attached by autogenous bonding at intermittent discrete regions to utilize the continuous filament web as a load bearing constituent of the material which has desired strength characteristics and possesses a textile-like appearance, drape and hand. In manufacture, the continuous filament web is formed by laydown of spun filaments on a foraminous carrier belt and the integrated microfiber mat is brought into laminar contact with the continuous filament web to form the unbonded two-ply laminate. Subsequently, the bonding attachment between the mat and web is effected by passage of the composite laminate through a pressure nip formed between heated rolls, one of which contains a plurality of raised points on its surface. An intermittent bond pattern preferably is employed, so that the area of the web occupied by bonds after passage through the nip is about 5–50% of the surface area of the materials, the discrete bonds being present at a density of about 50–1000/in$^2$. This patent discloses a multilayered web, but the layers are bonded by only a single thermal embossing step, so that it suffers the disadvantages referred to hereinabove, viz, loss of flexibility and soft surface texture.

U.S. Pat. No. 4,436,780 to H. W. Hotchkiss, et al. discloses a nonwoven wiper laminate including a relatively high basis weight intermediate layer of melt-blown thermoplastic microfibers, e.g., of polypropylene, and outer lightweight layers of generally continuous filament thermoplastic fibers, e.g., spunbonded polypropylene, having a larger average diameter. In the manufacture of the disclosed laminate, the respective layers are superpositioned relative to one another and the tri-plied composite then is passed through the nip between a patterned roll and anvil roll to pattern bond same. Again, this patent discloses a multilayer composite wherein a single embossing step is utilized for the composite.

U.S. Pat. No. 3,949,130 to R. M. Sabee, et al. discloses a spunbonded web of continuous synthetic filaments having one side that is at least two times smoother than the opposite side, wherein the majority of filament cross-points within the web are fuse-bonded to one another during the spinning of the web. The laydown of the filaments on a collection surface results in flattening on the laydown side to produce a smooth surface, the other side of the web comprising filaments which are randomly entangled to form a rough surface. Such web is disclosed to be useful in disposable diaper or like articles in which the rough side of the web faces and serves to anchor an absorbent pad, preferably also acting as a moisture carrier for wicking moisture through the web and into the absorbent pad, and the smooth side of the web provides a surface for comfortable contact with the baby's skin.

As shown in FIG. 6 of this patent, there is a steep density gradient from the smooth side to the rough side of the disclosed web, the density for the smooth side being approximately 0.32 gm/cm$^3$ and the density of the rough side being approximately 0.04 gm/cm$^3$. Thus, the smooth side of the web is of higher density which increases the difficulty of liquid penetrating into the web, in contradistinction to the rough side which is of lower density and, as mentioned in the patent's Abstract, has utility for wicking moisture through the web and into the absorbent pad. The disclosed web has texture characteristics on the respective sides which are appropriate for the intended use, i.e., a smooth side against the baby's skin and a rough side which serves to prevent shifting or displacement of the absorbent pad disposed contiguous thereto, but such textural characteristics are at odds with the function of the web in providing fast and intensive wicking action for removal of liquid from contact with the baby's skin. Accordingly, it would be appropriate if the density characteristics of the respective smooth and rough sides were reversed relative to that shown in FIG. 6, with the smooth side adjacent the baby's skin having a lower density and the rough side having a higher density thereby enhancing the anchoring action of the rough side while providing a low density, high loft fluffy baby-side surface.

U.S. Pat. No. 4,377,615 to M. Suzuki, et al. discloses a nonwoven fabric comprising an upper layer having a substantially smooth surface and a lower layer having a density lower than that of the upper layer. The upper layer comprises hydrophobic fibers as a principal element, the denier of which is finer than the denier of the lower layer, and contains a larger amount of adhesive bonding materials than the lower layer. The lower layer comprises hydrophilic fibers and hydrophobic fibers, the denier of which is coarser than the denier of the upper layer, and contains a smaller amount of adhesive bonding materials than the upper layer.

The Suzuki, et al. patent states that the upper and lower layers do not indicate a state wherein the thickness of the nonwoven fabric is equally divided into two but rather a case wherein a state of a plurality of fibrous webs formed through mixing of different fibers are overlapped to constitute a nonwoven fabric. The nonwoven fabric in such case is divided into an upper layer having a relatively higher density and a lower layer having a relatively lower density, density referring to the amount of fibers and adhesive bonding materials in each of the upper and lower layers, being averaged. The patent discloses to use fibers of polyester, polypropylene, acrylic, rayon, acetate and the like for each of the respective layers. The adhesive bonding materials described in this patent include those comprising as a main component acrylic ester copolymers, consisting of monomers such as ethylacrylate, methylacrylate and/or butylacrylate, wherein ethylacrylate is a major component.

In the manufacture of the nonwoven fabric disclosed in the Suzuki, et al. patent, the fibers for the respective layers are prepared, formed into webs and piled up by a plurality of cards. The resulting web then is guided to a saturator, where the web is dipped in a low-solids binder emulsion. The amount of binder applied to the lower layer by the saturator is comparatively small with respect to the upper layer, which downstream of the dip zone is sprayed with a higher-solids binder emulsion, whereby the upper layer has a greater binder content than the lower layer. Subsequently, the web is passed through serial driers, and then guided into contact of its upper higher density layer with a smooth-surfaced cylinder, where the web is forcibly pressed against the cylinder's surface by a plurality of rolls, to cure the web and provide a substantially smooth surface on its upper surface.

In the specification of the Suzuki, et al. patent, at column 5, line 45 to column 6, line 21 thereof, the preparation of various sample webs according to the disclosed invention is described, wherein the respective layers are formed and "these webs are piled." There is no disclosure of any type of bonding of respective layers in the web to one another; contrariwise, the webs are merely piled relative to one another, so that there is only a mechanical entanglement of fibers therebetween at the interface of the two layers. Although a bonding medium subsequently is applied to the respective top and bottom surfaces of the composite web, it would be expected that consistent with the teachings of the patent, there is no flow-through or penetration from one layer to another, since same would destroy the density gradation which is stated to be an object of the fibrous web according to the patent, i.e., each of the respective layers having its own specific density as associated with the extent of the bonding medium applied thereto. Thus, the interface will be defined by a comparatively loose assemblage of fibers which have a low level of structural integrity relative to one another so that constituent layers of the web may shift relative to one another in use. Further, the fibrous web described by this patent has a significant deficiency in that a substantially smooth surface is provided on the outer surface of the higher-density, more extensively bonded layer. Accordingly, the smooth surface in operation will function to oppose wicking or penetration of liquid through the laminated web to the contiguously positioned absorbent pad (disposed against its smooth surface). In other words, while the fluffy back surface of the fibrous web of this patent is effective to sorb fluid from a baby's skin, there is presented to such sorbed fluid a transmission barrier in the form of the substantially smooth surface positioned between such fibrous web and the absorbent pad.

U.S. Pat. No. 4,013,816 to R. N. Sabee, et al. discloses a stretchable spunbonded web suitable as a top-liner for a disposable diaper, pad, bandage and the like. The web is formed of a polyolefin and crossover points of the fibers do not rupture when the web is stretched to 50% of its original length, but maintains approximately its original structure. The web is made by melt-blowing polypropylene of less than 1.2 intrinsic velocity at a filament velocity at least 15 meters per second and at a denier per filament of 3, with webs being collected on a rotating chilled drum at 40°-65° F.

In U.S. Pat. No. 3,457,338 to L. E. Lefevre, there is disclosed a process for forming crimped polyolefin filaments of improved bulkiness, wherein the polyolefin material is extruded, at a melting temperature usually above about 130° C., through a multihole die or spinneret to form a multiple filament strand. The multifilament strand is surface chilled immediately after extrusion by subjecting the filaments to a transverse flow of an inert cooling medium, such as air or nitrogen, against their outer peripheries at a temperature less than the melting temperature, generally in the range of 5°-25° C. The coolant impinges on all of the hot filaments at the same predetermined distance from the extruding die while not forcing them into coherence with one another. The chilled filaments then are oriented and stretched to 1-4 times their original length, subsequently passing through a first heating zone wherein the filaments are twisted about their longitudinal axis in one direction at a temperature of about 100°-225° C. and then a second heating zone wherein the filaments are twisted about their longitudinal axis in a direction opposite to that in the first zone, at a temperature of from about 100°-225° C.

U.S. Pat. No. 3,480,709 to I. Jacob, et al. discloses the production of filaments of high molecular weight synthetic linear polymers with a three-dimensional crimp, formed from melt-spun filaments which are cooled rapidly on one side below the spinneret on a cylindrical or flat cooling body at a temperature of from 0°-70° C. After contact with the cooling body, the crimp of the filament is at first invisible and is imparted to the filament in a latent form, as evidenced by the fact that the individual filaments after leaving the cooling body can be collected without sticking together. When filaments with such latent crimp are drawn at room temperature, followed by a subsequent tension-free heat treatment at a temperature of from 70°-230° C., a helical three-dimensional crimp is created. The patent states at column 4, lines 22 et seq that the filaments may first be cut and the crimp thereafter developed either on the fibers or on the finished yarn, woven or knitted fabric or fleece.

U.S. Pat. No. 3,577,498 to T. Matsuo, et al. teaches to form bulky crimped polypropylene fibers by asymmetrically cooling or quenching the polypropylene filaments in the cross-sectional dimension thereof to create cross-sectional anisotropy, followed by stretching the filaments to a draw rate of at least 2.5 times and then heat treating same in a relaxed state at a temperature of 80°-150° C. to develop coil-like crimps in the fibers.

U.S. Pat. No. 3,920,784 to J. Nakhgawa, et al. discloses the production of crimped fibers from asymmetrically cooled filaments which are partly non-circular in cross-section. The disclosed cross-sectional shapes consist of a substantially circular basic part and two or three projections therefrom. The patent further discloses to enhance uniformity of crimps by subjecting the disclosed filaments after asymmetrical cooling to drawing and mechanical crimping, to provide 5 to 15 crimps per inch. The crimped filaments then are spread in the form of a tow to reduce their apparent density to less than 0.15 gm/cc and the tow is heated under zero tension conditions.

U.S. Pat. No. 4,159,297 to J. K. P. Mackie, et al. discloses forming crimped filaments of semi-crystalline polyolefins or blends thereof with other materials, by melt drawing filaments at a drawing rate of less than 100 meters per minute, followed by rapid and asymmetric cooling of at least portions of the filaments, which then are formed into a tow and subjected to heat treatment, without drawing, at a temperature of at least 100° C. The filaments thereafter are drawn in two stages, the last of which is at a temperature of at least 70° C., then relaxed and subjected to a further, crimp-developing heat treatment, which may be applied either to the filaments themselves or to products produced therefrom.

U.S. Pat. No. 4,346,052 to J. R. Knox discloses a process for forming homogeneous curly synthetic polymer fibers, wherein after melt spinning of fibers from a slow crystallizing synthetic polymer composition, longitudinal tensile forces are applied to the fibers above the crystallization temperature range during a controlled substantially axially symmetric cooling of the fiber. The fibers thus formed have a substantially axially symmetric, residual tensile force differential between their outer sheaths and inner portions, being generally of helical configuration with more than about 15 turns per linear centimeter.

SUMMARY OF THE INVENTION

In one aspect, the present invention relates to a fibrous web comprising fibers which have been differentially cooled to provide a crimped fiber conformation thereto and then thermally relaxed to a sufficient degree to at least partially decrimp such fibers and increase the loft and decrease the density of the web.

In another aspect of the present invention, there is provided an absorbent article comprising a fibrous web as described hereinabove, and an absorbent body in fluid transmissive communication therewith.

In another aspect, the present invention relates to a process for forming a fibrous web, comprising the steps of:

forming a web of fibers;

differentially cooling the fibers to provide a crimped fiber conformation thereto;

bonding the fibers to form a bonded web; and thermally relaxing the crimped fibers to a sufficient degree to at least partially decrimp the fibers and increase the loft and decrease the density of the web.

The fibrous web of the present invention is possessed of a soft texture with good hand characteristics, yet has sufficient mechanical strength and integrity for use as a liner in absorbent articles such as disposable diapers, sanitary napkins, incontinency briefs and the like.

In contrast to the previously described prior art involving the formation of crimped fibers, the present invention does not utilize heat treatment to develop the crimp, but contrariwise utilizes the heat treatment to thermally relax the crimped fibers to a sufficient degree to at least partially decrimp the fibers, thereby increasing the loft and bulk and decreasing the density of the fibrous web. Accordingly, the process of the present invention and the fibrous web produced thereby are opposite in character to the teachings of the prior art, which utilizes heat treatment to increase the extent of crimping in the fiber.

BRIEF DESCRIPTION OF THE DRAWINGS

The elements and features of the present invention will be more fully appreciated from the appended drawings, in which.

DETAILED DESCRIPTION OF THE PREFERRED EMBODIMENTS

Generally, the present invention provides an improved fibrous web suitable for use in absorbent articles such as disposable diapers, sanitary napkins, incontinency briefs, and the like, which fibrous web may comprise spunbonded fibers which are crimped yet have high bulking characteristics. The fibrous web of the invention has high loft and bulk, yet is possessed of good mechanical integrity. The present invention also provides a process for making a fibrous web of the aforementioned type. Other attributes and advantages of the present invention will be more fully apparent from the ensuing disclosure.

Figure 1:
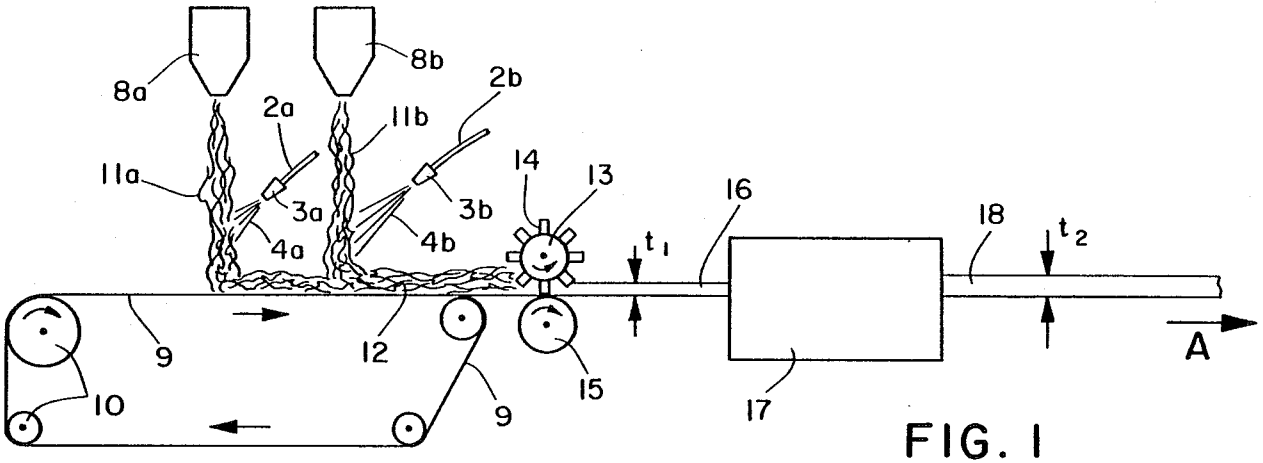
FIG. 1 is a schematic diagram of a process suitable for producing the fibrous web of the present invention.

Referring now to FIG. 1, there is shown a schematic diagram of a process system suitable for producing a fibrous web according to the present invention. The fibers are initially formed and discharged as shown in FIG. 1 in two streams 11*a* and 11*b* from the spaced-apart forming means 8*a* and 8*b*, respectively. The forming means 8*a*, 8*b* are representative of any suitable fiber forming means such as spinnerets, die orifices, melt-blowing apparatus, etc. The spun fibers discharged from the forming means fall by gravity or are fluid-entrained to deposit on foraminous forming surface 9 supported in turn on roller 10 driven by a suitable drive means (not shown), e.g., an electric motor.

The respective fibers streams during their downward descent for deposition on the foraminous forming surface 9 are cooled by means of the fluid discharge nozzles 3*a*, 3*b* respectively coupled by fluid supply lines 2*a*, 2*b* which deliver cold fluid from a source or sources (not shown). Cold fluid is discharged from the nozzles 3*a*, 3*b* in streams 4*a*,4*b*, respectively, and transversely directed against the respective fibers streams to differentially cool the fibers therein prior to their deposition on the forming surface.

The cold fluid may be any suitable fluid, preferably a gas, e.g., air, which is at a temperature below the temperature of the fibers impinged upon by the fluid streams so as to effect differential cooling thereof. By differential cooling in this context is meant a cooling induced by the flow of cold fluid past the fibers in a direction generally transverse to the movement of the fibers stream or streams, whereby the portions of the fibers which are windward or upstream with respect to the cold fluid flow path are cooled to a greater extent than the portions of the fibers which are leeward or downstream with respect to the cold fluid flow path. It is also within the purview of the present invention to effect differential cooling of the fibers by virtue of their inherent geometries, as described more fully hereinafter, and for the general practice of the present invention, differential cooling refers to the production of a temperature gradient transverse to the direction of movement of the fiber for deposition on the forming surface and/or transverse to the longitudinal axis of the fiber.

The differential cooling of the fibers in the respective fiber streams 11*a*, 11*b* provides a crimped fiber conformation to such fibers, i.e., the fibers as a result of the transverse temperature gradient curl and/or kink along their lengths to provide a shorter longitudinal or axial dimension for the fiber than prior to its being so cooled. The differentially cooled fibers are laid on the foraminous forming surface 9 to provide a web 12 of differentially cooled, crimped fibers. As illustrated in FIG. 1, web 12 separates from forming surface 9, and by virtue of translation of the foraminous forming surface in the direction denoted by the arrow A, web 12 is directed into and through the nip defined by adjacently positioned rolls 13 and 15. Roll 13 is patterned roll having protrusions 14 thereon, which may be in any suitable array for thermal pattern bonding of the web 12. The roll 15, which corporately with roll 13 defines a thermal pattern bonding nip, has a smooth surface. The patterned roll 13 is suitably heated by heating means (not shown) and is rotated by suitable means (also not shown), whereby the protrusions 14 are at elevated temperature to form in the web 12 a series of thermal pattern bonds corresponding to such protrusions, in a manner known in the art. As a result of the thermal pattern bonding, the web 12 of fibers is bonded across its transverse extent, to provide the pattern bonded web 16 of enhanced stability.

As shown in FIG. 1, the pattern bonded web 16 has a thickness $t_1$ and passes into thermal relaxation zone 17, wherein the web 16 is thermally relaxed to a sufficient degree to at least partially decrimp the fibers and increase the loft of the web and its bulk, while decreasing its density. The thermally relaxed web 18 exits from the thermal relaxation zone 17 at a thickness $t_2$, and is passed to further processing and/or end-use treatment steps, such as mating with an absorbent body to form a composite which then may be separated into discrete articles for use as disposable diapers, sanitary napkins and the like.

The thermal relaxation zone 17 is at sufficient elevated temperature to provide the at least partial decrimping of the fibers in the web required for increasing the loft (thickness) of the web and its bulk, concomitant with a decrease in the web's density. This is reflected by the increase in thickness of the web shown in FIG. 1, where the thermally relaxed thickness of the web 18 is measured by the dimension $t_2$, which is greater than the corresponding thickness dimension $t_1$ of the differentially cooled web 16 prior to such thermal relaxation treatment.

The thermal relaxation zone 17 may utilize any suitable heating means which are effective to raise the temperature of the fibers in the web 16 to the desired level, such as radiant heat lamps, or bulk hydrodynamic flow of a heat transfer gaseous medium through the housing defining zone 17.

The fibers utilized for the fibrous web of the present invention may be of any suitable material generally satisfactory for formation of fibers, such as polypropylene, polyethylene, polyester, nylon, rayon, polyurethane, cellulose and compatible blends thereof.

Further, although the web of fibers 12 in FIG. 1 has been shown and described with respect to pattern thermal bonding of the web, it will be appreciated that any other method useful for satisfactorily bonding of fibers to form bonded webs is within the broad scope of the present invention. Suitable alternative bonding methods include ultrasonic bonding, needling, bonding with binders, adhesives and the like, and fluid entanglement of the constituent fibers, as well as area thermal bonding (as contrasted to pattern thermal bonding). Further, it is within the scope of the present invention to employ bicomponent fibers as the fibers of the present invention, comprised of high melting temperature inner core portions and low melting temperature outer or sheath portions. In such bicomponent fiber systems, the low melting temperature outer portions of the respective fiber are subjected to elevated temperature sufficient to fusibly bond the fibers at their points of contact with one another.

A preferred fiber for use in the present invention is a spun polypropylene fiber. In the practice of the process exemplified with reference to FIG. 1, the thermal relaxation step results in a decrimping which preferably reduces density by a factor of at least 1.2 and more preferably by a factor of at least 1.5. The fibers useful in the present invention may have any suitable intrinsic density characteristics (intrinsic density here referring to the density of the material in the fiber per se, as contrasted to the apparent density in the fibrous web including void space). However, it is preferred for utility in end-use absorbent article applications such as disposable diapers and the like to utilize a material having an intrinsic density in the range of from about 0.01 to 0.15 grams per cubic centimeter. For the preferred polypropylene materials the fiber denier is from about 10 to 30 microns, and the intrinsic density is from about 0.03 to about 0.07 gm/cc.

Figure 2:
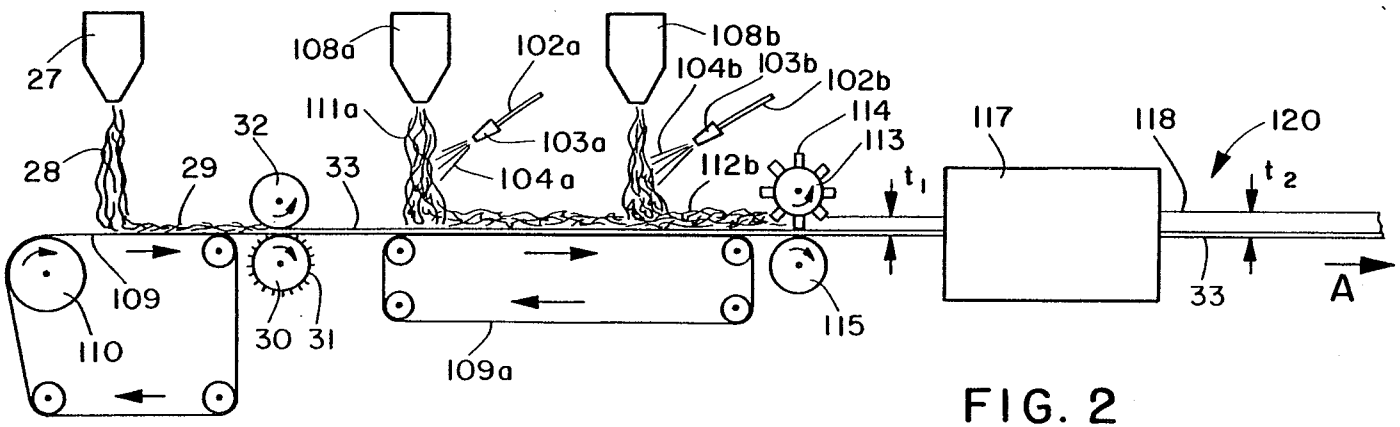
FIG. 2 is a schematic diagram of an alternative process for producing the fibrous web of the present invention, as part of a multiple layer laminate, on a base layer of greater density wherein the fibers are more strongly bonded to one another than fibers in the web layer according to the present invention.

FIG. 2 is a schematic diagram of a process system suitable for forming an alternative fibrous web construction according to the present invention, wherein the fibrous web is laminated with and bonded to a layer of higher density material. In the illustrated process system, elements are numbered correspondingly with respect to the same or analogous elements in FIG. 1, by addition of 100 to the reference numeral of the corresponding element in FIG. 1. Thus, the foraminous forming surface 109 disposed on rotatable roller 110 provides a laydown surface for the fibers discharged from the fibe forming means. A first fiber forming means 27 discharges a stream 28 of high density fibers to form the web 29 on the forming surface. The web 29 then passes through a nip defined by rolls 30 and 32. Roll 30 has on its outer surface a plurality of protrusions 31 while roll 32 has a smooth outer surface mating therewith to provide for thermal pattern bonding of the web 29, by means of the protrusions 31 on the roll 30, such protrusions being heated (by means not shown) during rotation (by means also not shown) of the roll 30. The density of the protrusions on roll 30 is substantially higher than the density of the protrusions 114 on roll 113, to be described hereinafter.

The thermal pattern bonding of web 29 provides a pattern bonded web 33 surface, which moves on foraminous surface 109*a* in the direction shown by the arrows to provide a base substrate for a fibrous web formed analogously to the fibrous web described hereinabove in connection with FIG. 1. That is, fibers are discharged from the fiber forming means 108*a*, 108*b* in respective fibers streams 111*a*, 111*b* which are differentially cooled by cold fluid streams 104*a*, 104*b* discharged from nozzles 103*a*, 103*b* joined to respective cold fluid supply lines 102*a*, 102*b*. The differentially cooled fibers then are deposited on the base substrate web 33 as an upper fibrous web 112.

The resulting composite web, comprising fibrous web 112 and base substrate layer 33, then passes along direction A and through the nip defined by pattern roll 113 and smooth-surfaced roll 115 to thermally pattern bond the fibers in the upper fibrous web 112 to one another and concurrently to bond the upper fibrous web 112 to the substrate layer 33, resulting in a composite thermally bonded web wherein the upper fibrous web has a preliminary thickness $t_l$.

Although the fibrous web 112 in FIG. 2 has been shown and described with respect to pattern thermal bonding of the web, other suitable bonding methods may also be employed. Suitable alternative bonding methods include ultrasonic thermal bonding, needling, bonding with binders, adhesives and the like, as well as area thermal bonding.

The bonded, composite web then passes through thermal relaxation zone 117, constructed analogously to the thermal relaxation zone 17 in FIG. 1, wherein the upper fibrous web is thermally relaxed to a sufficient degree to at least partially decrimp the fibers and increase the loft and bulk of the web. The thickness of the upper fibrous web increases from thickness $t_1$ to a relaxed, expanded thickness $t_2$, and the density of the upper web decreases. The resulting composite web 120, comprising an at least partially decrimped upper fibrous web 118 and base substrate layer 33, then is passed to further downstream treatment and/or end-use processing steps.

In practice, the process system schematically illustrated in FIG. 2 may utilize a multibank spunbond machine to produce the composite fibrous web 120. The base substrate layer 33 would be formed by the first one or more banks of such multibank spunbond machine to produce the strong base substrate layer of the composite. The remaining spinning banks of the spunbond machine would form the soft, lower density upper fibrous web 112 on top of the base substrate layer 33. The upper fibrous web 112 for such application is thermal bonded to the base substrate layer 33 at a very low percent bond area in order to preserve the low density, velvet-like loft of the unbonded synthetic filaments. The fuzziness and loft of the upper fibrous web could be enhanced by brushing or other mechanical treatment, as per se known in the art. The composite fibrous web 120 thus has a large degree of compressibility or "cushiness" provided by the low density, lofty, upper fibrous web. The length of the filaments produced by the forming means for the spun fibers may be adjusted as necessary and/or desirable in a given end use to enhance the velvet-like texture of the upper fibrous web. Preferably, when relatively short, discontinuous filaments are employed, these filaments are meltblown fibers.

Figure 3:
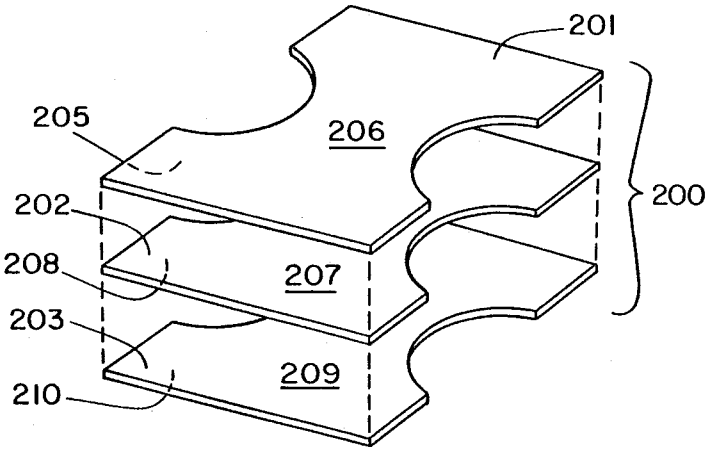
FIG. 3 is an exploded perspective view of a disposable diaper absorbent article according to the present invention, comprising as a liner layer a fibrous web according to the present invention.

FIG. 3 is an exploded perspective view of an absorbent article according to the present invention, wherein the article 200, shown here as a tri-laminated structure suitable for use as a disposable diaper, comprises the respective layers 201, 202 and 203. The top layer 201 is a fibrous web according to the present invention, functioning as a liner for the disposable diaper, with a top surface 206 adapted for contact to the skin of the wearer. The bottom surface 205 of the liner layer 201 is disposed adjacently to the intermediate layer 202 which is an absorbent body of a material such as air-felt or cellulosic batting, having an upper surface 207 contiguous to the lower surface 205 of the liner 201, with a bottom surface 208 in contact with the bottom layer 203. The bottom layer 203 is a fluid-impervious sheet material whose top surface 209 is abuttingly disposed against the bottom surface 208 of the absorbent layer 202, and with the bottom surface 210 of the fluid-impervious layer 203 providing an outer surface for the disposable absorbent article. In the parlance of the art, the liner layer 201 is a topsheet, fluid-impervious sheet bottom layer 203 is a backsheet, and disposed therebetween is the absorbent layer 202. Each of the layers is separately formed and mated in a conventional manner, with the margins of the respective layers featuring symmetrically opposed arcuate cutouts defining leg openings to accommodate a contoured fit to the body of the wearer.

Figures 4, 5, 6:
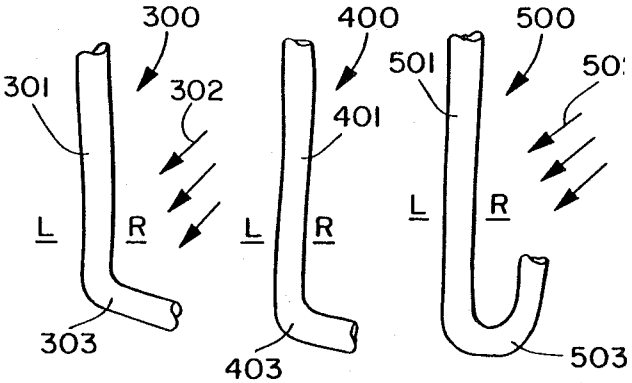
FIG. 4 is an elevational view of a portion of a spun fiber, illustrating the differential cooling thereof.
FIG. 5 is an elevational view of a section of a spun fiber, illustrating an alternative method of differentially cooling such fiber.
FIG. 6 is an elevational view of a portion of a spun fiber, showing a still further method of differentially cooling same, which is inclusive of the methods illustrated with reference to FIGS. 4 and 5.
Figures 4A, 5A, 6A:
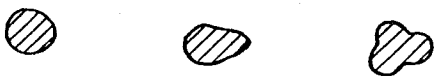
FIGS. 4A, 5A, and 6A show cross sections of the respective fibers of FIGS. 4, 5, and 6.

FIGS. 4, 5 and 6 show elevational views of sections of respective spun fibers as utilized in the fibrous web of the present invention. FIGS. 4A, 5A and 6A show the corresponding cross sections of the respective fibers.

Referring to FIG. 4, there is shown a segment of fiber 300 comprising a main axial segment 301 which is approximate in temperature to the temperature of the fiber as formed, i.e., at the spinneret or die orifice opening. The lower portion 303 of such fiber is crimped under the influence of a cold fluid which impinges on the fiber, as indicated by flow lines 302, in the righthand region R, so that there is a cooling gradient between the lefthand region L of the fiber and the righthand region R. As a result of this cooling gradient, the fiber acquires an asymmetric, differential contraction and thermal set, wherein a crimped fiber conformation is imparted to portion 303 thereof. As shown in FIG. 4A, the cross section of fiber 300 can be circular in shape.

FIG. 5 shows an elevational view of a segment of a corresponding fiber 400 comprising a main axial segment 401 and a crimped lower portion 403. No lateral impingement of cold fluid is utilized to form the crimped fiber conformation shown in FIG. 5, but rather the crimped conformation is achieved by use of a non-circular, shaped cross section, as shown in FIG. 5A. Due to such non-circular cross section the fiber 400 will cool and solidify in the low mass areas of the cross section, in region R, before the higher mass areas in region L cool and solidify. Such action produces a differential contraction within the fiber, and will result in the fiber crimping, as shown.

The effect of differential cooling by virtue of a non-circular, or more particularly, a shaped or asymmetric fiber cross section can be further enhanced with concurrent differential cooling by impingement of a cold fluid. This is shown in FIG. 6, where fiber 500 comprising a main axial portion 501 has a cold fluid, indicated by the flow lines 502, transversely directed against it, resulting in differential cooling to provide the crimped fiber conformation at section 503. As shown in FIG. 6A, the cross section of the fiber 500 can have a trilobal shape.

Figure 7:
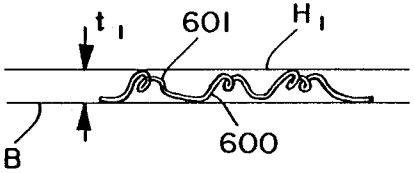
FIG. 7 is an elevational view of a fiber of the fibrous web of the present invention, prior to its thermal relaxation, referenced positionally to a base plane B.

FIG. 7 shows a crimped fiber conformation of an exemplary fiber 600, such as may be obtained by differential cooling of the spun fiber to provide a plurality of curls and kinks 601 along its length. For purposes of illustration, the crimped fiber is shown positioned relative to a base plane B which may for example be coincident with the foraminous forming surface 9 of FIG. 1, or 109 of FIG. 2. The loft or thickness $t_1$ of the fiber is measured by the vertical distance between the base plane B and a plane $H_1$ parallel thereto and disposed at the average height of the crimped fiber.

Figure 8:
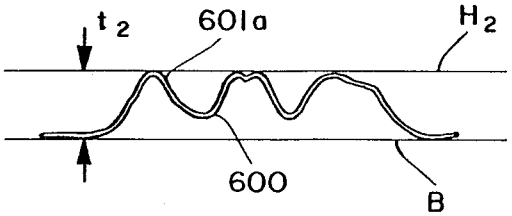
FIG. 8 is an elevational view of the fiber of FIG. 7, after thermal relaxation to a sufficient degree to at least partially decrimp the fiber, resulting in an increase in loft as compared to the fiber prior to such thermal relaxation.

In FIG. 8 there is shown a corresponding view of the fiber 600 after same has been thermally relaxed to an extent sufficient to at least partially decrimp the fiber, as representatively shown by the uncurling and unkinking of fiber portion 601*a*, as compared to the corresponding fiber portion 601 in FIG. 7. As a result, the average thickness or loft of the fibrous web containing a plurality of such fibers will increase, consistent with the increased fiber loft or thickness $t_2$, measured as the distance from the base plane B to the plane $H_2$ parallel thereto and defining the average height of the fiber. The loft of the decrimped fiber is increased markedly with respect to the thickness dimension $t_1$ of the fiber measured before thermal relaxation, as shown in FIG. 7. Thus, the heating of the web after differential cooling of the fibers therein, to effect thermal relaxation of such fibers causes the curls and kinks therein to loosen and stretch out, yielding an increase in the loft and an expansion of the bulk of the web. Concomitant with such increase in the loft and bulk of the fibers and fibrous web, there is achieved a corresponding reduction in density of the fibrous web, as mentioned hereinabove.

While the thermal relaxation of the differentially cooled fibers may in some instances be conducted prior to bonding of the fibers to form a web of a bonded character, it is generally preferred in the practice of the present invention to conduct such thermal relaxation step after the fibers have been bonded in the web. Likewise, it may in some instances be feasible to differentially cool the fibers subsequent to bonding thereof to form a bonded web, however it is generally preferable to differentially cool the spun fibers prior to bonding of same in the web.

The following examples are presented to provide a more detailed understanding of the invention. The particular quantities, proportions and parameters set forth are exemplary and are not intended to specifically limit the scope of the invention.

EXAMPLES 1–4

Various types of fibrous webs were produced in accordance with the invention, and 6 in×6 in samples of each type of web were prepared. The webs incorporated circular and non-circular cross section fibers which had been differentially cooled with an air jet directed against one side thereof. The samples were heated in an oven at a temperature of 120° F. (about 49° C.) for a time period of about 10 min. Caliper thickness measurements were taken before and after the heat treatment, and the results are set forth in the following Table 1.

TABLE 1

| Sample | Filament Shape | Before Caliper (inch) | After Caliper (inch) | Gain |
|---|---|---|---|---|
| 1 | circular | 0.011 | 0.012 | +9% |
| 2 | circular | 0.014 | 0.017 | +21% |
| 3 | trilobal | 0.017 | 0.021 | +24% |
| 4 | trilobal | 0.013 | 0.013 | 0% |

EXAMPLES 5–18

The amount of the increase in bulk will depend upon the heat treatment temperature and the length of time over which the fibrous web is treated. For example, filaments having 6 denier and a trilobal cross section were spunbond to form a fibrous web having a basis weight of about 0.62 oz/yd$^2$ (about 21.2 g/m$^2$). The fibrous web was ultrasonically thermal bonded to a fibrous substrate base layer that had a basis weight of about 0.4 oz/yd$^2$ (about 13.7 g/m$^2$) to produce a composite web having a basis weight of about 1.0 oz/yd$^2$ (about 34.2 g/m$^2$). Samples of the composite web were heat treated in an oven at a temperature of about 140° F. for various time periods, and the Ames bulk of each sample was measured before and after the heat treatment. The results are set forth below in Table 2.

TABLE 2

| Sample | Oven Time | Initial Ames Bulk (inches) | Ames Bulk After Heating | % Bulk Increase |
|---|---|---|---|---|
| 5 | 10 sec | .026 | .037 | 42% |
| 6 | 20 sec | .027 | .039 | 44% |
| 7 | 30 sec | .026 | .041 | 57% |
| 8 | 40 sec | .027 | .046 | 70% |
| 9 | 1 min | .027 | .050 | 85% |
| 10 | 2 min | .028 | .047 | 67% |
| 11 | 3 min | .027 | .044 | 62% |
| 12 | 4 min | .028 | .051 | 82% |
| 13 | 5 min | .029 | .048 | 65% |
| 14 | 6 min | .028 | .048 | 71% |
| 15 | 7 min | .028 | .045 | 60% |
| 16 | 8 min | .027 | .045 | 66% |
| 17 | 9 min | .030 | .047 | 56% |
| 18 | 10 min | .026 | .046 | 76% |

EXAMPLES 19–32

In another experiment, filaments having 4.8 denier and a substantially circular cross section were spunbond to form a fibrous web having a basis weight of about 0.74 oz/yd$^2$ (about 25.3 g/m$^2$). The fibrous web was ultrasonically bonded to a fibrous base layer that had a basis weight of about 0.4 oz/yd$^2$ (about 13.7 g/m$^2$) to produce a composite web having a basis weight of about 1.2 oz/yd$^2$ (about 41.0 g/m$^2$). Samples of the composite web were heat treated in an oven at a temperature of about 140° F. for various time periods, and the Ames bulk of each sample was measured before and after the heat treatment. The results are set forth below in Table 3.

TABLE 3

| Sample | Oven Time | Initial Ames Bulk (inches) | Ames Bulk After Heating | % Bulk Increase |
|---|---|---|---|---|
| 19 | 10 sec | .034 | .035 | 3% |
| 20 | 20 sec | .031 | .033 | 6% |
| 21 | 30 sec | .028 | .032 | 14% |
| 22 | 40 sec | .027 | .031 | 15% |
| 23 | 1 min | .025 | .035 | 40% |
| 24 | 2 min | .025 | .034 | 36% |
| 25 | 3 min | .027 | .031 | 14% |
| 26 | 4 min | .027 | .034 | 25% |
| 27 | 5 min | .028 | .035 | 25% |
| 28 | 6 min | .027 | .035 | 29% |
| 29 | 7 min | .025 | .032 | 28% |
| 30 | 8 min | .027 | .034 | 25% |
| 31 | 9 min | .028 | .034 | 21% |
| 32 | 10 min | .028 | .033 | 17% |

The Ames bulk data set forth in the above examples were derived employing an Ames thickness (bulk) tester Model 3223 (or equivalent) available from B. C. Ames Company, Waltham, Mass. The tester was equipped with a long range dial indicator, 0–100 dial units with 0.001" graduation, having a full span of 3.0 inches. The compression spring was removed as well as the raising and lowering arm. A J50B Universal joint (available from Wisconsin Bearing Company, Appleton, Wisc.) was fabricated and attached to the bottom of the vertical weight attachment rod, and to the top of a 5"×5" platen. The total weight of the platen, weight attachment rod, and added weights was 0.4 lbs±0.01 lbs (182±5 grams).

Ten 4"×4" samples were cut making certain that there were no folds, creases, wrinkles, etc. in the sample selected. The 10 samples were measured to determine an average sample thickness or "bulk." The platen was raised sufficiently to place one sample on the bed plate, centered under the 5"×5" platen as much as possible. The platen was then gently released onto the material, and a reading was taken 15–20 seconds after the platen was released on the material. The bulk or thickness was measured to the nearest 0.001 inch. The ten measurements were arithmetically averaged to determine an Ames bulk value.

Although the invention has been described with respect to preferred embodiments, it will be appreciated that numerous variations, modifications and other embodiments are possible, and that all such apparent variants, modifications and embodiments are to be regarded as being within the scope and spirit of the present invention.

What is claimed is:

1. A process for forming a fibrous web, comprising the steps of:

(a) differentially cooling said fibers to produce an asymmetric, differential contraction and thermal set therein, whereby said fibers are provided with a crimped conformation;

(c) bonding said fibers to form a bonded web; and (d) heating said crimped fibers to thermally relax the fibers to a degree sufficient to at least partially decrimp said fibers, thereby increasing the loft and decreasing the density of said web.

2. A process as recited in claim 1, wherein said forming step (a) comprises the step of forming a web composed of fibers having a noncircular cross-section.

3. A process as recited in claim 2, wherein said forming step (a) includes forming said web with meltblown fibers.

4. A process as recited in claim 2, wherein said forming step (a) includes forming said web with spunbond fibers.

5. A process as recited in claim 1, wherein said heating step (d) decreases the density of said web by a factor of at least 1.2.

6. A process as recited in claim 1, wherein said heating step (d) decreases the density of said web by a factor of at least 1.5.

7. A process as recited in claim 1, further comprising the step of bonding and laminating to said fibrous web, a fibrous layer which has a higher density than said web.

8. A process according to claim 1, wherein said differential cooling of said fibers is carried out prior to said bonding thereof.

9. A process according to claim 1, wherein the fibers are differentially cooled after bonding thereof.

10. A process according to claim 1, wherein the fibers are decrimped subsequent to bonding thereof.

11. A process according to claim 1, wherein the fibers are decrimped prior to bonding thereof.

* * * * *

UNITED STATES PATENT AND TRADEMARK OFFICE

CERTIFICATE OF CORRECTION

PATENT NO. : 4,783,231

DATED : November 8, 1988

INVENTOR(S) : John M. Raley

It is certified that error appears in the above-identified patent and that said Letters Patent is hereby corrected as shown below:

Column 11, line 12, delete "fibe" and substitute therefor --fiber--.

Column 16, after line 13 and prior to line 14, insert the following sub-paragraph -- (a) forming a web of fibers; --.

Column 16, line 14, delete "(a)" and substitute therefor -- (b) --.

Signed and Sealed this

Twenty-seventh Day of June, 1989

*Attest:*

*Attesting Officer*

DONALD J. QUIGG

*Commissioner of Patents and Trademarks*